US005195187A

United States Patent [19]

Yang

[11] Patent Number: 5,195,187

[45] Date of Patent: Mar. 23, 1993

[54] POCKETED GARMENT

[76] Inventor: Chen Y. Yang, 11912 Riding Loop Ter., North Potomac, Md. 20878

[21] Appl. No.: 714,801

[22] Filed: Jun. 13, 1991

[30] Foreign Application Priority Data

Jul. 5, 1990 [CN] China ..... 90103437.1

[51] Int. Cl.[5] ..... A41D 1/04; A41D 13/00

[52] U.S. Cl. ..... 2/102; 2/247; 2/108; 2/94; 2/69

[58] Field of Search ..... 2/69, 93, 86, 88, 94, 2/102, 108, 105, 106, 114, 115, 108, 247, 248, 249, 250, 251, 252, 253

[56] References Cited

U.S. PATENT DOCUMENTS

| | | | |
|---|---|---|---|
| 321,177 | 6/1885 | Beals | 2/102 X |
| 1,444,750 | 2/1923 | Moore | 2/94 |
| 2,448,416 | 8/1948 | Carter | 2/94 |
| 2,448,449 | 8/1948 | Masland | 2/94 |
| 2,678,447 | 5/1954 | Braken | 2/94 |
| 4,241,459 | 12/1980 | Quayle | 2/102 |
| 4,470,155 | 9/1984 | Maeshima | 2/108 |
| 4,513,455 | 4/1988 | Gerhardt | 2/253 X |
| 4,637,075 | 1/1987 | Ingrisano et al. | 2/94 |
| 4,637,076 | 1/1987 | Tartt et al. | 2/94 X |
| 4,651,348 | 3/1987 | Swanson | 2/253 X |
| 4,864,656 | 9/1989 | Nesse | 2/108 X |
| 5,014,359 | 5/1991 | Hanson | 2/94 |

FOREIGN PATENT DOCUMENTS

| | | | |
|---|---|---|---|
| 2561510 | 9/1985 | France | 2/108 |
| 2588451 | 4/1987 | France | 2/108 |
| 498339 | 9/1954 | Italy | 2/102 |
| 862877 | 3/1961 | United Kingdom | 2/102 |
| 1241164 | 7/1971 | United Kingdom | 2/94 |

*Primary Examiner*—Andrew M. Falik
*Assistant Examiner*—Jeanette E. Chapman
*Attorney, Agent, or Firm*—James A. Wong

[57] ABSTRACT

A pocket garb composed of front and back pieces is provided with pockets of large capacity on the front and back pieces, wherein the back piece pocket has two upper and lower openings, available to be separated with a partition in the middle, the said large pocket can be partitioned into two small pockets for use according to requirement, the front piece pockets have a side opening each adjacent to a joint of a left piece and a right piece, with a covering attached on it to cover up pocket openings, shoulder parts of the said pocket garb are fastened with fastenings, the garb can be developed into a flat piece after untieing the fastenings to facilitate putting in or taking out articles. When going out, valuables, bank notes, credentials, etc. can be put into the garb and safety can be guaranteed on wearing it.

9 Claims, 10 Drawing Sheets

POCKETED GARMENT

BACKGROUND OF THE INVENTION

The present invention relates to a garb, particularly to a garb with large capacity pockets.

At present, many countries in the world are rampant with robbers and thieves everywhere. Robbers and thieves are known to go after any of various types of valuables including bank notes, checks, remittance bills, credit cards, passports, and important documents carried by persons performing daily routine transactions, such as making purchases, collections, deliveries, tours, etc. On occasions when people go to the bank to draw a large sum of cash, or when owners of stores or restaurants take their daily cash receipts home or to deposit in the bank, they have to carry large sums of cash by themselves; when salesmen are on a trip to promote sale of goods, they also have to carry expensive samples as wrist watches, jewelry, necklaces and designs. Generally, such articles are carried in a portfolio, suitcase or handbag. However, such containers are visible and easily to be stolen, looted or lost. If these valuables are to be held in garb pockets, ordinarily the pockets are too small and inadequate.

OBJECTS OF THE INVENTION

The object of the present invention is to provide a kind of protective pocket garb having pockets of large capacity, which can contain large quantities of money or articles like a portfolio, suitcase or handbag and can be worn as an ordinary piece of clothing.

The composition of the present invention is a protective pocket garb composed of front and back pieces, with large capacity pockets provided respectively on the front pieces and the back piece. The back piece pocket has upper and lower openings and may be used as a large pocket or when desired separated by a partition so as to provide two separated smaller pockets according to requirement. Each front piece has at least one pocket with a side opening, adjacent to a left joint and the other front piece having a pocket with a side opening adjacent a right piece joint of the garb front piece. These two left and right pockets can be used simultaneously to receive articles of relatively large size. The present invention will also provide a covering to cover up the above-mentioned left and right piece joint and the side openings of the left and right pockets, and will provide further openings on the upper portion of the front piece pocket. In addition, the shoulder part of the said pocket garb of the present invention is fastened with a fastening, and the said garb can be developed after untieing the fastening to receive articles conveniently. Meanwhile, pockets on the front piece of the said pocket garb can be made open to the pocket of the back piece, whereby the entire garb will be changed to a large bag after being developed.

The advantages of the present invention include: first, since the said garb shoulder part is connected by a fastener and pockets on the front piece can be open to the pocket on the back piece, therefore the said garb can be converted to a large bag available to contain a lot of articles after disconnecting the fastener; second, the said garb can be developed into a flat piece to be placed on a plane surface as a tabletop or the like, to facilitate putting in or to taking out articles; third, all openings of pockets of the said pocket garb of the present invention are rather big, thereby garbs of the present invention are available to contain numerous articles as well as to place articles of larger area and volume; fourth, if the garb of the present invention is made of transparent material, and samples are placed in the pockets, it can be used by a salesman as a miniature show window to facilitate deals.

BRIEF DESCRIPTION OF THE DRAWINGS

With reference to accompanying drawings, a brief description to various embodiments of the said pocket garb of the present invention is made as follows to explain the objects, features, and advantages, wherein.

DETAILED DESCRIPTION OF THE INVENTION

The said pocket garb may be tailored either in long sleeve or short sleeve. However, for convenience to wear and for saving in cost it is designed in the fashion of a vest.

Figure 1:
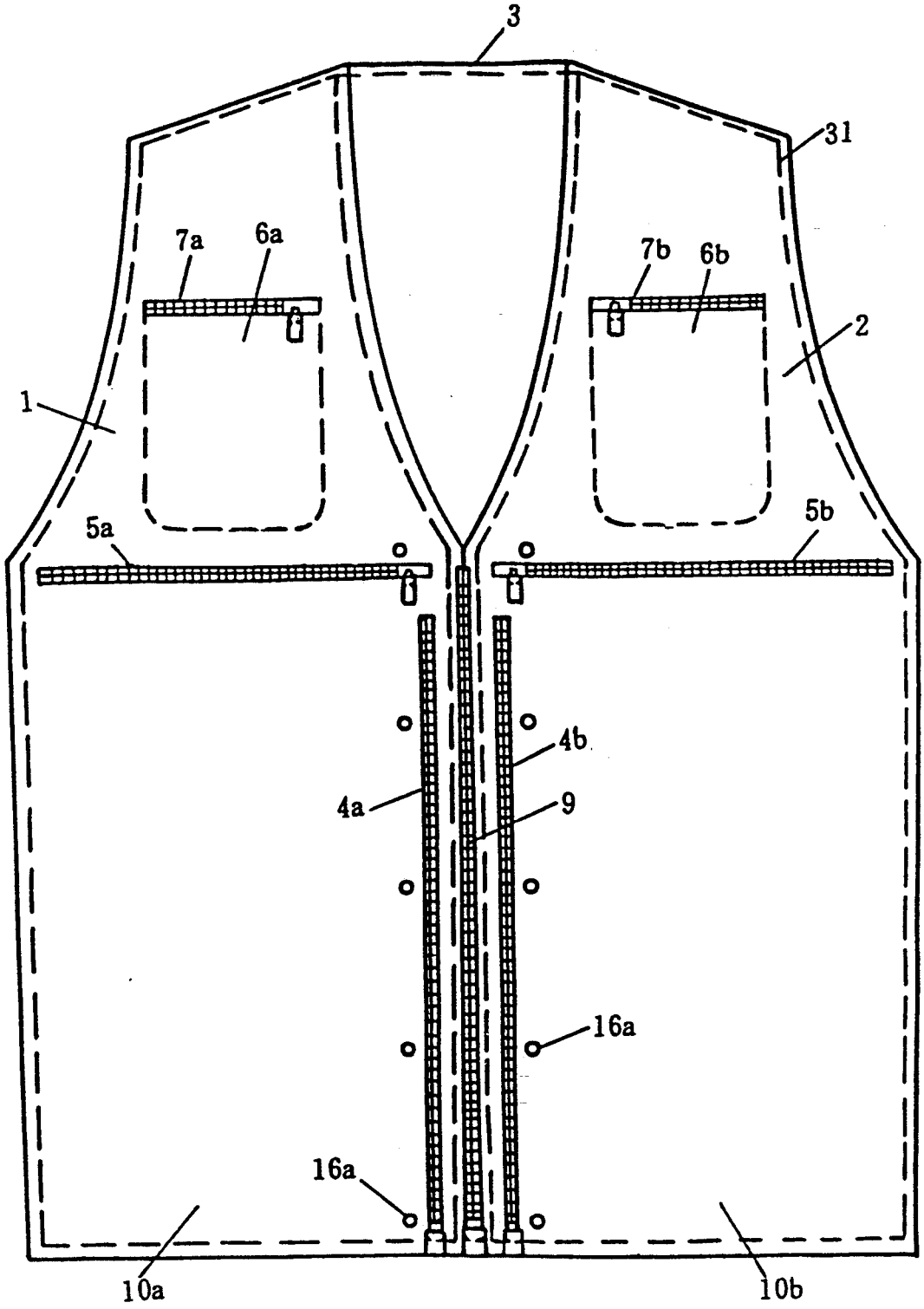
FIG. 1 is a front exterior schematic drawing of the first embodiment of the said pocket garb of the present invention.

Now referring to FIG. 1, as shown, the said pocket garb of the present invention comprises front pieces 1, 2, and a back piece 3 which are all composed of an outer layer and a lining 31 as an inner layer. Front pieces 1, 2 can be fastened by a fastener such as a zipper 9 or a row of snap-fasteners or buttons. As shown in FIG. 1, pockets 10*a* and 10*b* are provided on left piece 1 and right piece 2, respectively. For convenience to put articles into pockets 10*a*, 10*b*, each pocket 10*a*, 10*b* is provided with two openings on the outer layer of the front piece respectively, of which side openings 4*a*, 4*b* adjacent to two sides of zipper 9 are closed by fasteners such as zipper, snap-fastener, or button and the like. To facilitate putting in and removing articles, additional openings 5*a*, 5*b* are provided on the outer layer of the front piece at the top of pockets 10*a*, 10*b*. Openings 5*a* and 5*b* are also closed by fasteners such as zipper, or the like.

On each side of side openings 4a, 4b is provided a row of snap-fasteners 16a which can be buttoned up with snap-fasteners 16b on a front piece covering 27 in FIG. 4 to be mentioned below. At the upper part of pockets 10a, 10b, between the outer layer and the inner layer or lining front pieces 1, 2 of the pocket garb of the present invention are also provided with small attached pockets 6a, 6b for holding small articles. Openings 7a, 7b of the attached pockets 6a, 6b are closed with zipper respectively, but may instead be closed with snap-fasteners.

Figure 2:
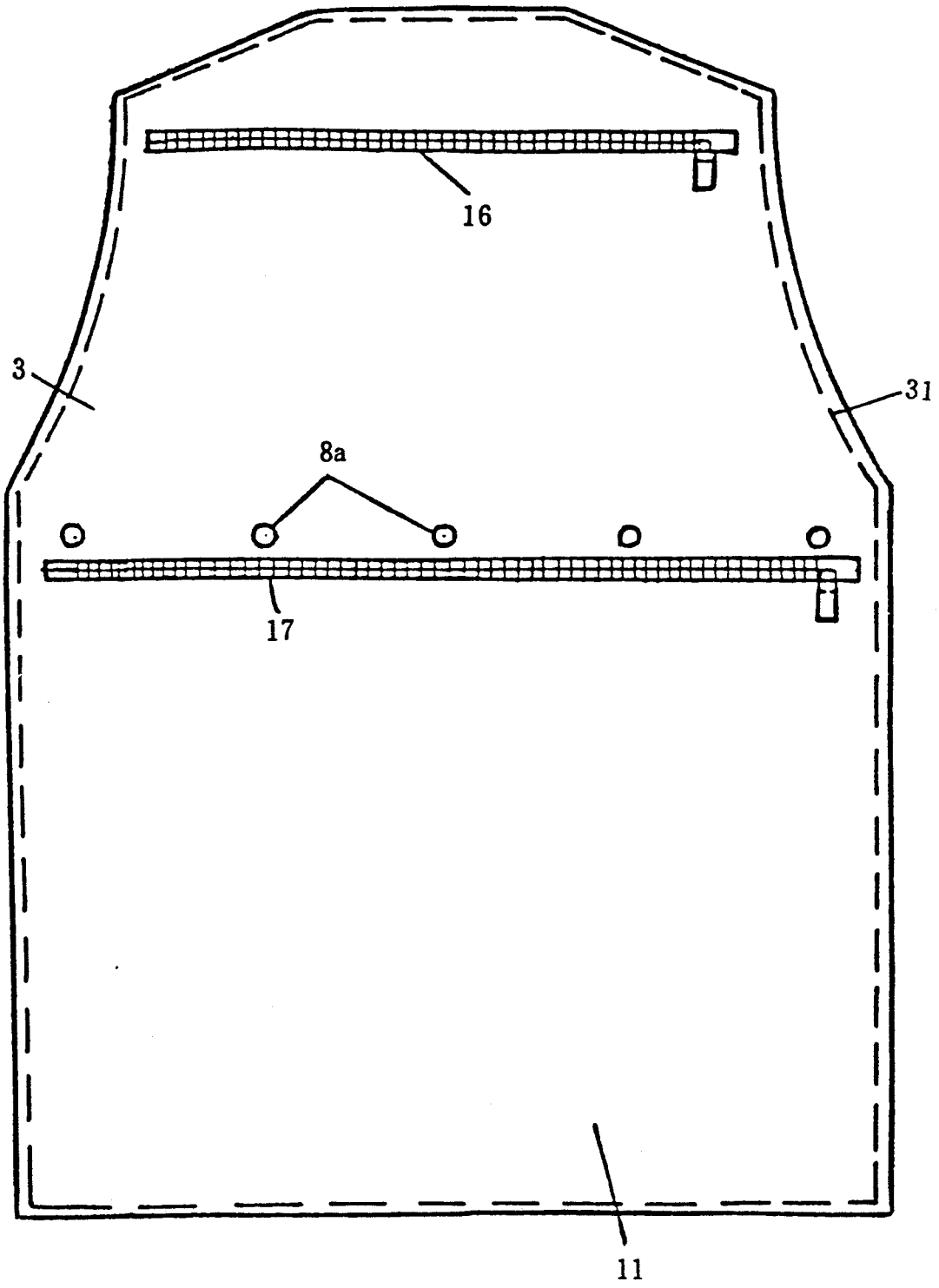
FIG. 2 is a back exterior schematic drawing of the first embodiment of the said pocket garb of the present invention.

There is a very large pocket 11 on the back piece 3 between the outer layer and inner layer or the lining of the said pocket garb of the present invention, as shown in FIG. 2. The pocket 11 has two openings 16 and 17 which are closed with fasteners as zipper or the like. At the upper part of opening 17, the inner side of back piece 3 is provided with a row of snap-fasteners 8a available to partition or divide the pocket 11 into upper and lower pockets. Then the pocket 11 is available to contain bulkier articles as well as to receive small articles. When pocket 11 is holding small articles, snap-fasteners 8a are buttoned up so that articles in the upper part of pocket will not drop.

Figure 3:
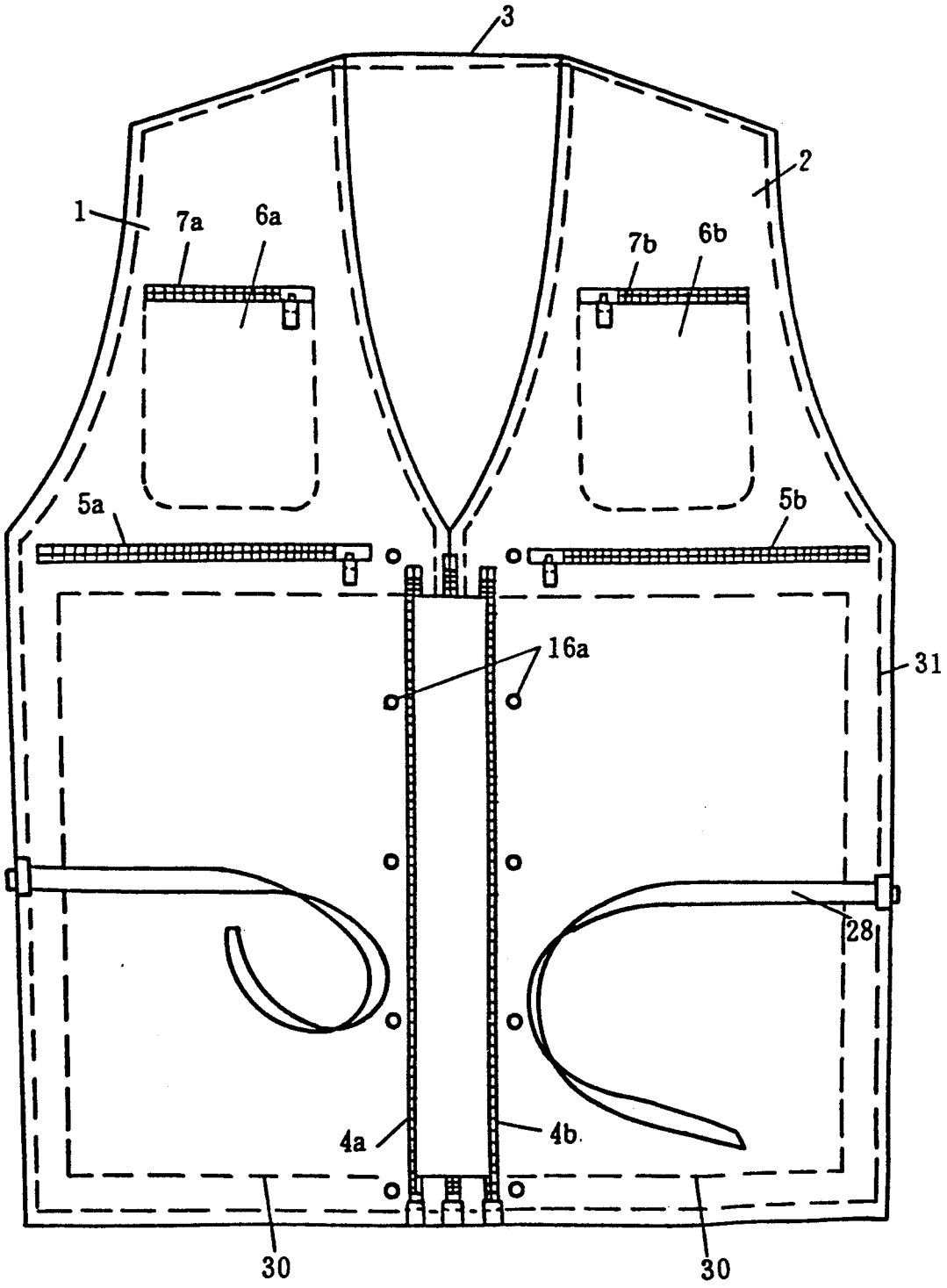
FIG. 3 is a front schematic drawing of the first embodiment of the said pocket garb of the present invention with large size documents or certificates put therein.

FIG. 3 is a schematic drawing of the pocket garb suitable for receiving and storing large size documents or certificates therein. As shown, one half of a document 30 is put into the left pocket and the other half in the right pocket.

Figure 4:
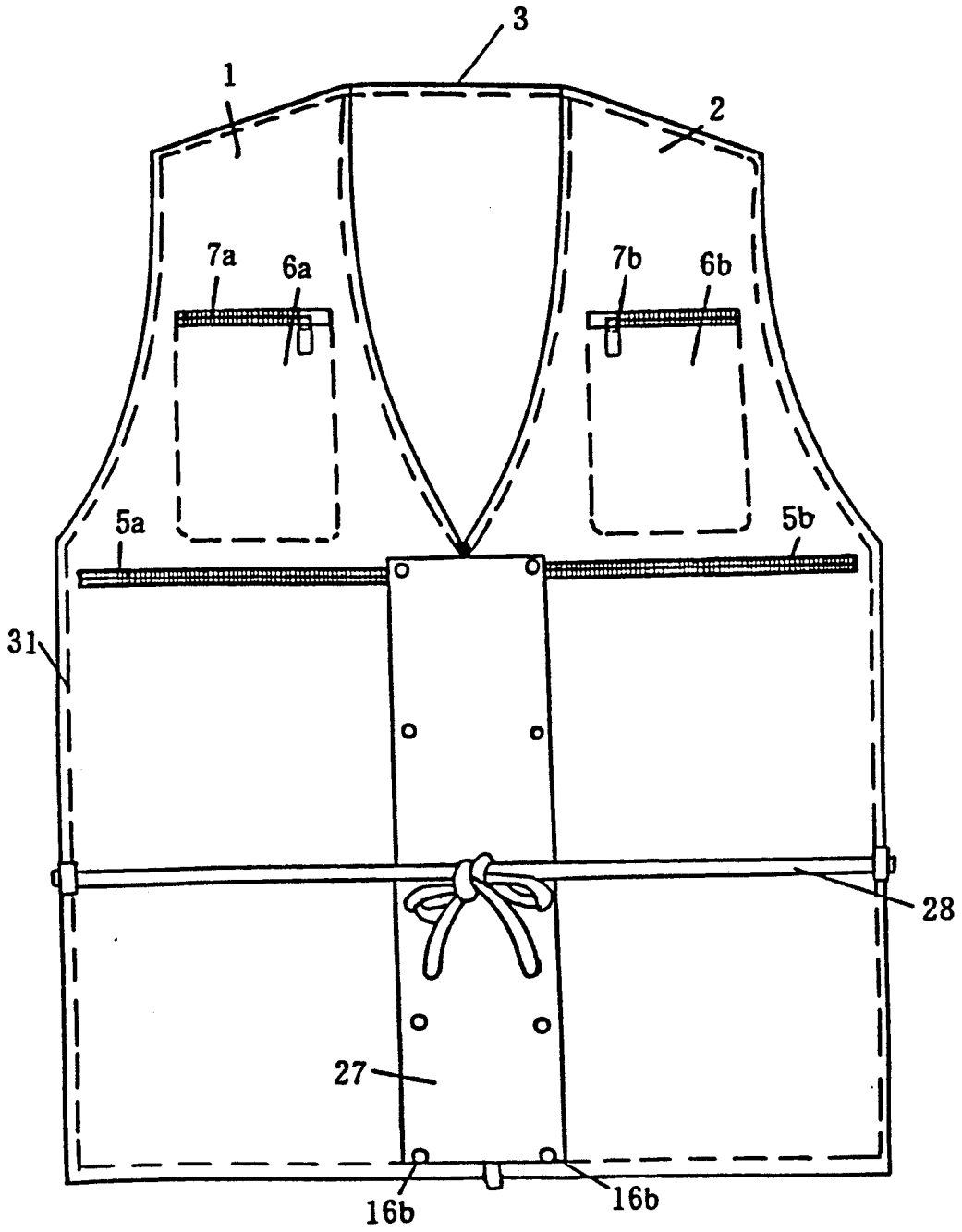
FIG. 4 is a front schematic drawing of the first embodiment of the said pocket garb of the present invention with a front piece pocket covering.

FIG. 4 shows the said pocket garb of the present invention with a covering 27 for the front piece. On covering 27 are two rows of snap-fasteners 16b which can be buttoned up with snap-fasteners 16a in FIG. 1, so as to cover up the adjoining portion of the front left and right pieces 1, 2, and openings 4a, 4b of pockets 10a, 10b. The covering 27 is preferably to be of the same cloth as the garb.

Generally speaking, it is more convenient to put daily necessities in the front pocket when going out, while using the back pocket to hold large size documents or certificates. At nighttime, articles in the back pocket can be moved to the front pocket by pulling open the vertical zippers on the sides of front left and right pockets and putting in one half of the large size documents or certificates 30 in left pocket and the other half in right pocket as shown in FIG. 3. Then as shown in FIG. 4, the covering 27 is buttoned up with snap-fasteners 16b. For safety, after putting on the said vest fashion pocket garb, a band 28 may be used to tie and cover it up.

Figure 5:
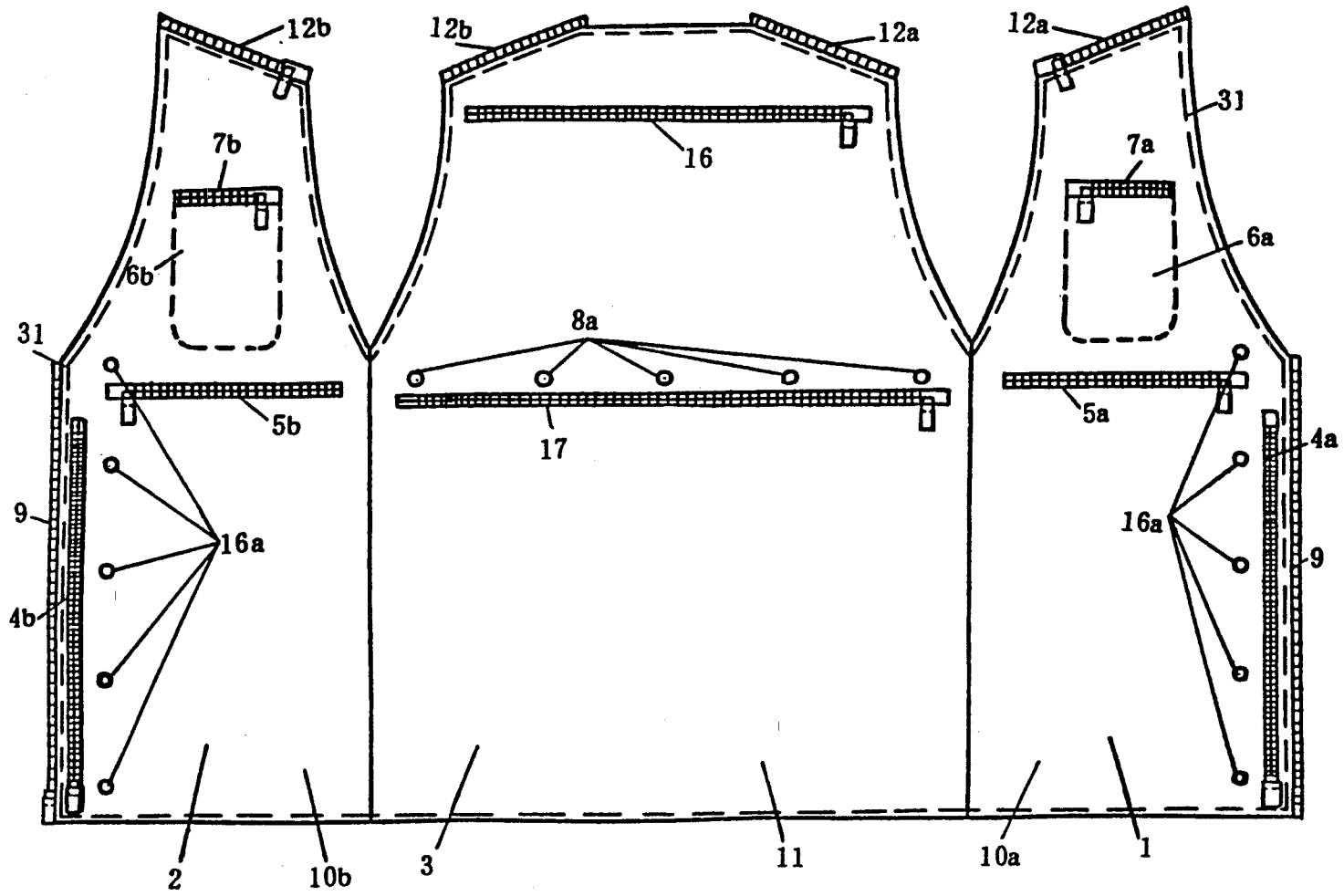
FIG. 5 is a developed exterior drawing of the first embodiment of the said pocket garb of the present invention.

FIG. 5 is a developed exterior drawing of the first embodiment of the said pocket garb, wherein its shoulder parts are joined with zippers 12a, 12b, and hence the said vest style pocket garb can be developed to a flat piece after being disjoined. It is convenient to put in or take out articles after placing the developed pocket garb on a tabletop. Meanwhile, pockets 10a, 10b of the front pieces are open in the interior to pocket 11 of the back piece, thereby the garb can be turned into a large bag after being developed.

As shown in FIG. 5, a method of making of the first embodiment of the said pocket garb is to use a piece of cloth and cut as per pattern with the back and front pieces lined with a piece of layer lining 31 of equal size and then to sew up edges to form a large bag, and the interiors are open to each other. The said large bag may be partitioned into three pockets, i.e., the left and right pockets on the front piece and the pocket on the back piece by sewing up or providing with snap-fasteners on the joining portions between said pockets.

Figure 6:
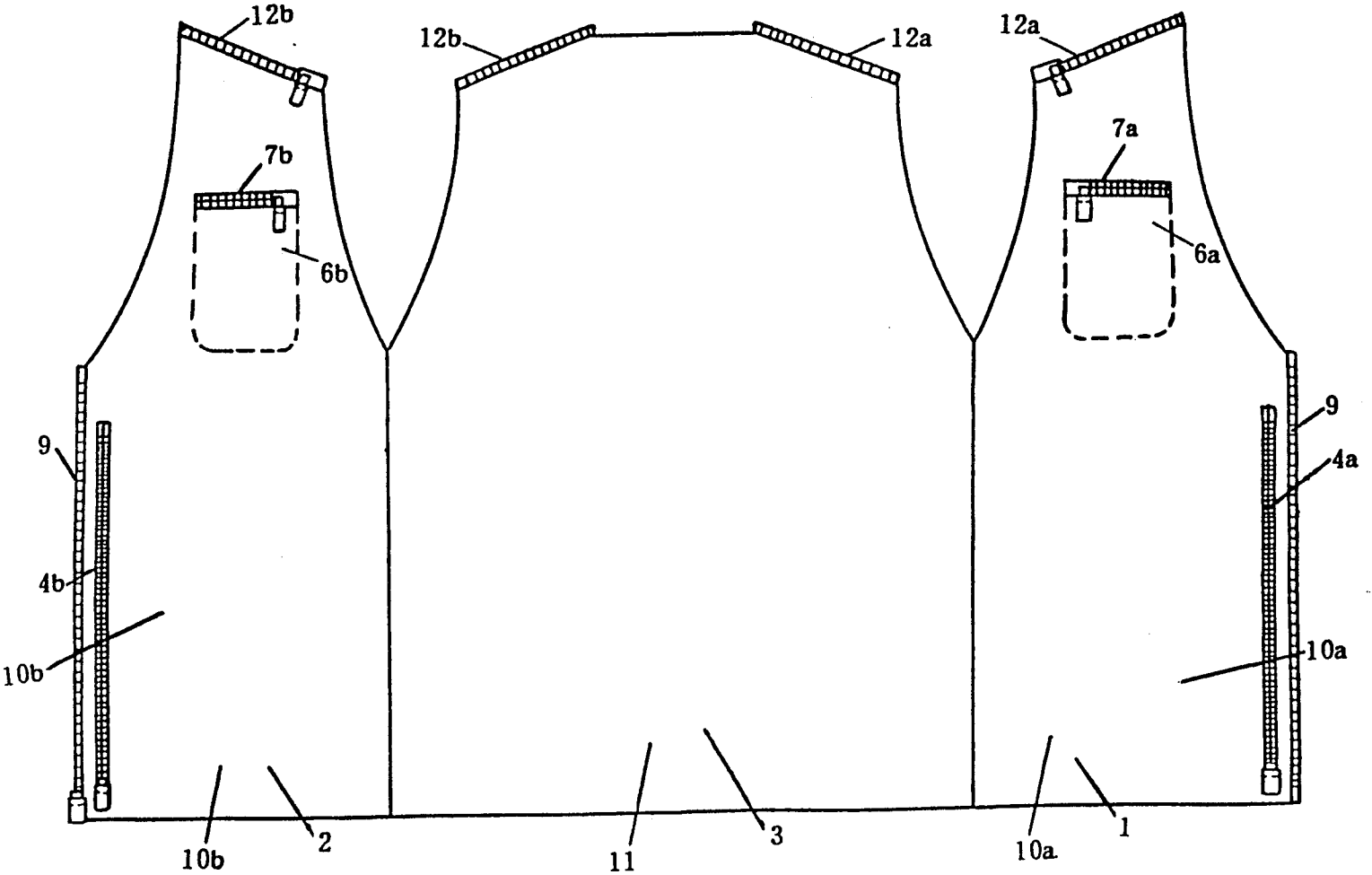
FIG. 6 is a developed exterior drawing of the second embodiment of the said pocket garb of the present invention.

FIG. 6 is a developed exterior drawing of the second embodiment of the said pocket garb of the present invention, wherein the side opening 4a, 4b of the pockets 10a, 10b on front pieces are all provided in the outer side of the pocket garb.

Figure 7:
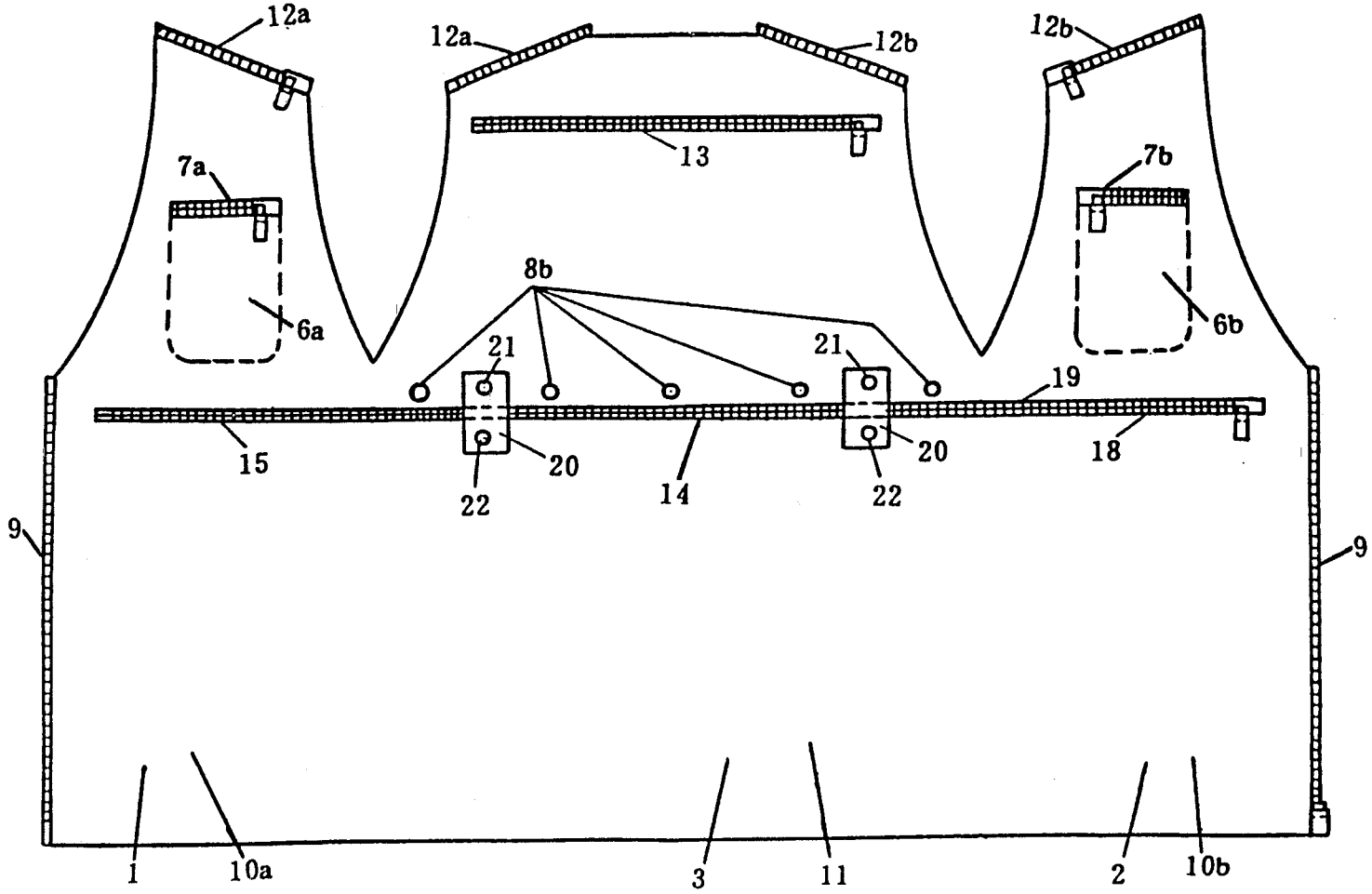
FIG. 7 is a developed drawing showing the interior of the second embodiment of the said pocket garb of the present invention.

FIG. 7 is a developed interior drawing of the second embodiment of the said pocket garb of the present invention, wherein the upper openings of the said pockets 10a, 10b and the openings of pocket 11 are all provided in the inner side of the pocket garb. Two openings 13, 14 of pocket 11 are closed in the same manner by fasteners as zippers or the like. Also, a row of snap-fasteners 8b at the upper part of opening 14 acts in the same manner as that row of snap-fasteners 8a as shown in FIG. 2 to partition the pocket 11 into the two pockets, at least one upper and one lower pocket after being buttoned up. Pockets 10a, 10b are open to pocket 11 in the interior and openings 15, 18 of pockets 10a, 10b are open to the opening 14 of the pocket 11, such that openings 15, 14 and 18 can be closed or opened by a single zipper 19. With the increase in length of zipper, it tends to disengage from gripping under a larger pressure. In order to prevent such occurrences, two adjoining leather facings 20 are provided in addition on the zipper of pocket 11, whose upper ends are fixed by buttons 21 and whose lower ends are either turnable around or fixed on the garb by snap-fasteners 22. As shown in FIGS. 6 and 7, a method of making of the second kind of pocket garb is to place the front and back pieces together with the inner side of the outer layer opposite to the inner side of the inner layer of the pocket garb and to sew up the edges to complete the pocket garb. In case of necessity, the inner side can also be sewn up or partitioned by snap-fasteners into a few smaller pockets.

Figure 8:
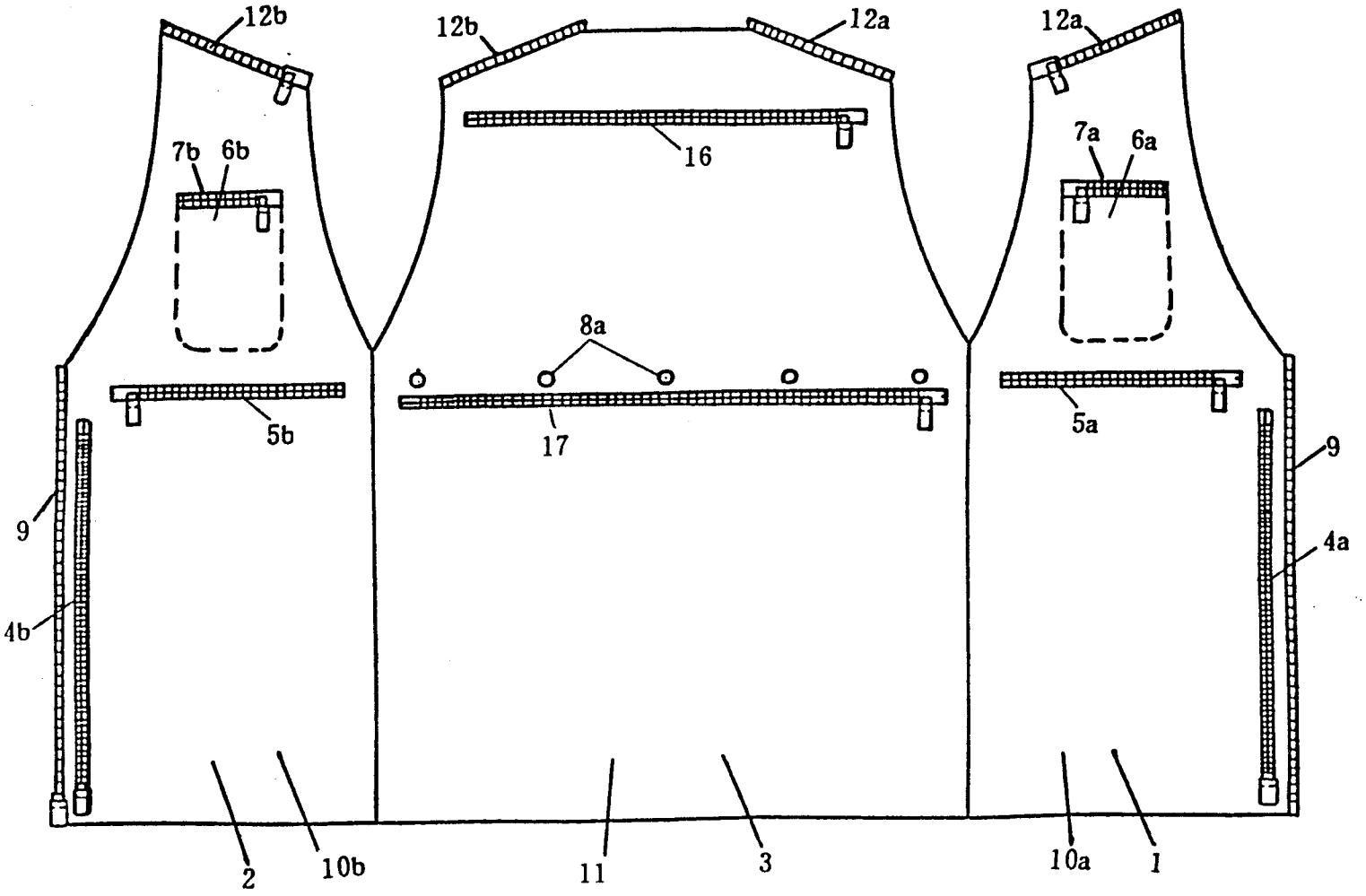
FIG. 8 is developed exterior drawing of the third embodiment (triplex pocket garb) of the said pocket garb of the present invention.
Figure 9:
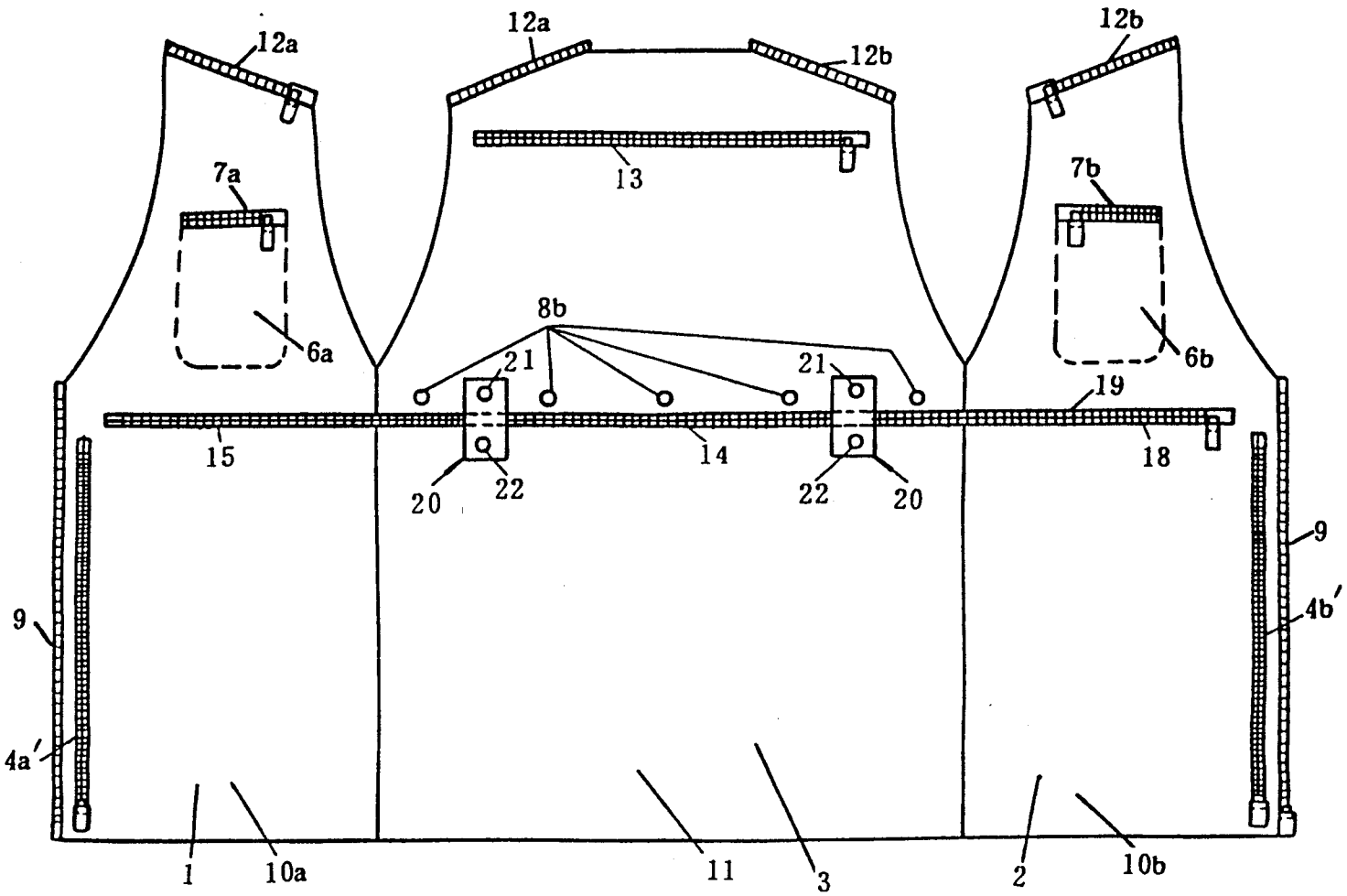
FIG. 9 is a developed interior drawing of the third embodiment (triplex pocket garb) of the said pocket garb of the present invention.

Shown in FIGS. 8 and 9 is a third embodiment of the present invention wherein the pocket gart is made of three layers of cloth, i.e., an inner layer (FIG. 9) and an outer layer (FIG. 8) between which is sandwiched a middle layer lining of equal size, so as to partition pockets of the inner and the outer layers.

FIG. 8 is a developed exterior drawing of a pocket garb with a middle layer, wherein side openings 4a, 4b of the front piece pockets, upper openings 5a, 5b, and openings 16, 17 of the back piece pockets of the pocket garb are all provided on the outer layer of the pocket garb.

FIG. 9 is a developed interior drawing of a pocket garb with a middle layer, wherein side opening 4a', 4b 'of the inner layer of the front piece pockets, upper openings 15, 18 and openings 13, 14 of the back piece pockets of the pocket garb are all provided in the inner layer of the pocket garb (not the middle layer) and openings 15, 18 and 14 are open to each other, and are closed or opened with a single zipper 19, similar to the second embodiment as shown in FIG. 7. To prevent zipper 19 from disengagement, two joining leather facings 20 are provided in addition on the zipper of back piece opening 14. As shown in FIG. 8 and 9, a method of making of the third kind of pocket garb is to place the front and back pieces together with the inner side of the outer layer opposite the inner side of the inner layer of pocket garb, but a piece of cloth of equal size is inserted between, and edges of these three pieces are then sewn up to complete the triple layer pocket garb. In case of necessity, the interior can also be sewn up or partitioned by snap-fasteners into a few smaller pockets.

Figure 10:
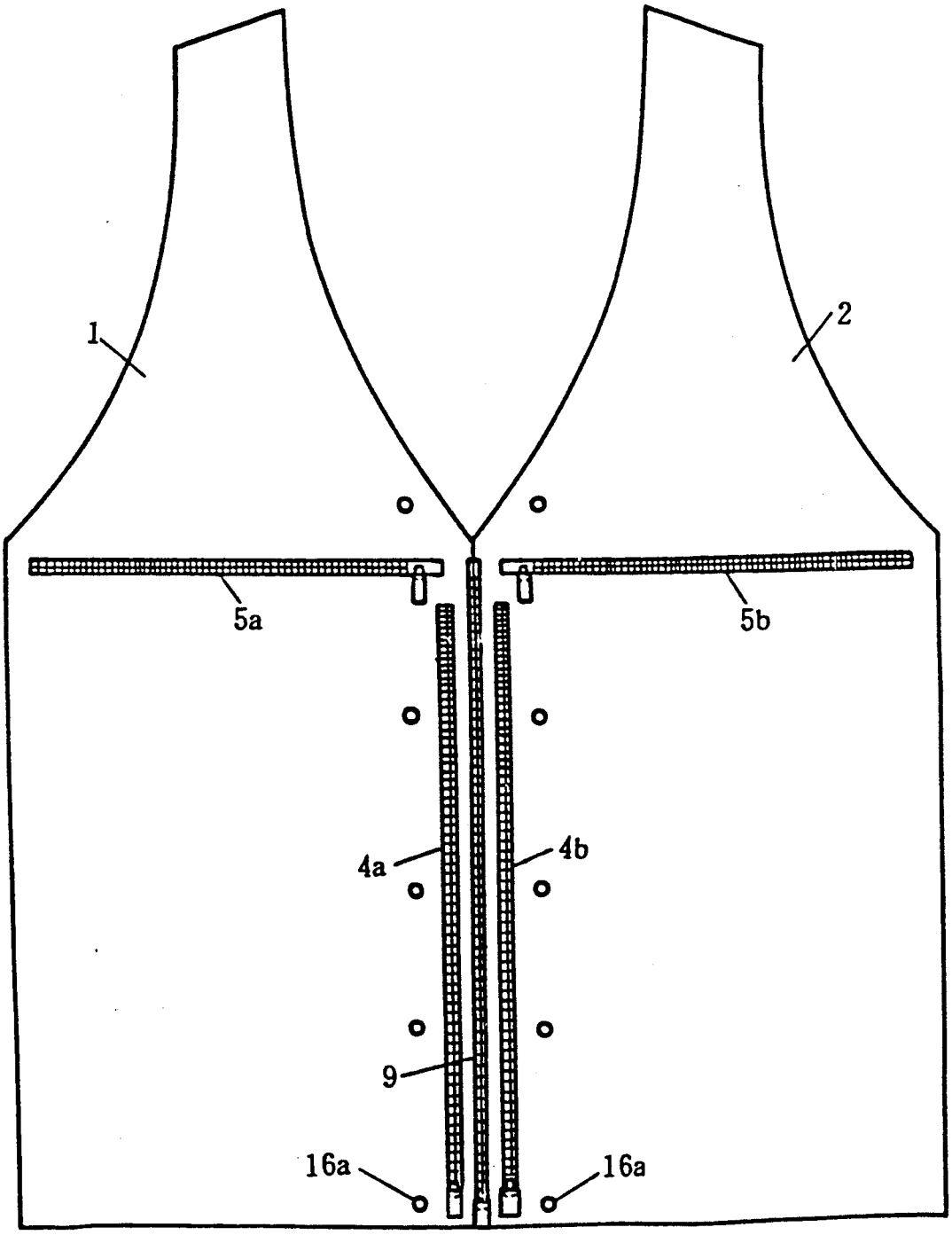
FIG. 10 is a schematic drawing of another fashion (called cool clothe for short) of the said pocket garb of the present invention.

For convenience to put on or take off, the said pocket garb of the present invention adopts the fashion of a vest, as shown in FIGS. 1–9. In case of only few articles to be put in or wearing in summer hot season, the upper portion of said pocket garb can be made in the fashion resembling garments of the type commonly referred to as tank tops which, as in the instant case, would expose substantial portions of the back, shoulder and chest, as shown in FIG. 10. Garments of the foregoing construction can readily be recognized for their inherent comfort and cooling effect, particularly during the hot summer reason. The disclosed garment may also have three fashions similar to those shown in the above-mentioned FIGS. 1–9.

The outside and the inside of the above-mentioned embodiments of the protective pocket garb of the present invention are interchangeable.

The said pocket garb of the present invention can be made of any material that can be used to make clothes, such as cotton, linen, silk, rayon, and the like. Attention is to be made in case of using materials of poor permeability, such as hide, leatheroid, and plastics and rubber fabrics, then permeating holes must be provided.

I claim:

1. A pocketed garment comprising:

a) a pair of front pieces formed from an inner layer and an outer layer;

b) a back piece formed of an inner layer and an outer layer and said back piece interconnecting said front pieces;

c) said front pieces and said back piece having large capacity pockets formed between said outer and inner layers and said pieces including openings for said pockets;

d) said pocket of said back piece having at least one of said openings being an upper opening and at least one other of said openings being a lower opening;

e) means for dividing or partitioning said large capacity pocket of said back piece into smaller pockets accommodate smaller articles, said dividing or partitioning means being located between said upper and lower openings of said pocket of said back piece;

f) one of said front pieces being a left front piece, the other of said front pieces being a right front piece, each of said front pieces having a joint for attachment to each other;

g) each of said front piece pockets having a side opening adjacent to one of said joints of said front pieces;

h) covering means removably attachable to said front pieces to cover said joints and said side openings adjacent thereto; and i) shoulder parts and fastening means therefor to effect assembly of said garb, said fastening means including means for being readily disjoined whereby said garb may be developed into a flat piece to facilitate insertion and removal of articles in and out of said pockets of said garb.

2. The pocketed garment according to claim 1 wherein said front pieces (1), (2), and said back piece (3) openings are front and rear openings (4*a*), (4*b*), (5*a*, ), (5*b*), and (16), (17) formed in the outer layer.

3. The pocketed garment according to claim 1 wherein said front pieces (1), (2), and said back piece (3) openings are side openings (4*a*), (4*b*) formed in the outer layer, and are upper openings (15), (18), and (13), (14) formed in the inner layer.

4. The pocketed garment according to claim 4 wherein said front pieces (1), (2), and said back piece (3) include an additional middle layer, and said are front and rear openings (4*a*), (4*b*), (5*a*), (5*b*), and (16), (17), formed in the outer layer, and said are front and rear openings (4*a*'), (4*b*'), (15), (18) and (13), (14) formed in the inner layer.

5. The pocketed garment according to any one of claims 1, 2, 3, or 4, wherein two small pockets (6*a*), (6*b*) with openings (7*a*, ), (7*b*) are formed on an inside upper portion of the front pieces (1), (2), respectively.

6. The pocketed garment according to any one of claims 1 or 2, 3 or 4 wherein said partitioning means of the back piece pocket comprises a row of snap-fasteners (8*a*) or (8*b*).

7. The pocketed garment according to any one of claims 1 or 2, 3 or 4 wherein said openings of said pockets and the joint of the left and right pieces of the front piece include closing means from the group consisting of zippers, snap-fasteners or buttons.

8. The pocket garment according to any one of claims 1 or 2, 3, or 4, wherein said fastenings (12*a*), (12*b*) at the shoulder parts are from the group consisting of zippers or snap-fasteners.

9. The pocketed garment according to any one of claims 1 or 2, 3, or 4 wherein said garb further comprises two rows of snap-fasteners (16*a*), one of said rows of snap-fasteners (16*a*) being adjacent to the joint of said left front piece and the other of said rows of snap-fasteners (16*a*) being adjacent to the joint of said right front piece on the front piece pockets and wherein said covering means further comprises two rows of snap-fasteners (16*b*) available to be placed over and be buttoned up to said two rows of snap-fasteners (16*a*) adjacent to the joint of the left and right pieces on the front piece pockets, if articles to be put into the pocket are too large, the two left and right pockets can be used simultaneously and then openings of said left and right pockets will be covered up with the covering, and in addition a band (28) may be used to tie around the garment.

* * * * *